US008096549B2

(12) United States Patent
Shimizu

(10) Patent No.: US 8,096,549 B2
(45) Date of Patent: Jan. 17, 2012

(54) IMAGE GENERATING APPARATUS

(75) Inventor: Daisuke Shimizu, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 595 days.

(21) Appl. No.: 11/838,633

(22) Filed: Aug. 14, 2007

(65) Prior Publication Data

US 2008/0048391 A1 Feb. 28, 2008

(30) Foreign Application Priority Data

Aug. 22, 2006 (JP) ..... 2006-006755

(51) Int. Cl.
*B65H 1/08* (2006.01)

(52) U.S. Cl. ..... 271/147

(58) Field of Classification Search ..... 271/147, 271/148, 160, 22, 24, 128, 30.1, 156, 157
See application file for complete search history.

(56) References Cited

U.S. PATENT DOCUMENTS

| | | | | |
|---|---|---|---|---|
| 3,741,537 | A * | 6/1973 | Lange | 271/165 |
| 4,219,192 | A * | 8/1980 | Burke | 271/160 |
| 4,265,442 | A * | 5/1981 | Cormier et al. | 271/127 |
| 5,052,836 | A | 10/1991 | Genno | |
| 5,222,725 | A * | 6/1993 | Kasahara et al. | 271/160 |
| 5,328,163 | A | 7/1994 | Yamada | |
| 5,397,191 | A | 3/1995 | Murakami et al. | |
| 5,398,108 | A * | 3/1995 | Morinaga et al. | 399/381 |
| 5,482,390 | A | 1/1996 | Murakami et al. | |
| 5,494,364 | A | 2/1996 | Murakami et al. | |
| 5,829,898 | A * | 11/1998 | Hill et al. | 400/624 |
| 2006/0071402 | A1 | 4/2006 | Takasaka et al. | |

FOREIGN PATENT DOCUMENTS

| | | | |
|---|---|---|---|
| JP | 2-175526 | * | 7/1990 |
| JP | 4-323121 | * | 11/1992 |
| JP | 5-8867 | A | 1/1993 |
| JP | 5-132194 | A | 5/1993 |
| JP | 5-201573 | A | 8/1993 |
| JP | 6-255805 | A | 9/1994 |
| JP | 6-286265 | A | 10/1994 |
| JP | 7-41717 | U | 7/1995 |
| JP | 2740215 | B2 | 1/1998 |
| JP | 2006-76718 | A | 3/2006 |
| JP | 2006-143446 | A | 6/2006 |

OTHER PUBLICATIONS

Japanese Office Action dated Oct. 19, 2006 with English translation (Five (5) pages).

* cited by examiner

*Primary Examiner* — Stefanos Karmis
*Assistant Examiner* — Thomas Morrison
(74) *Attorney, Agent, or Firm* — Crowell & Moring LLP

(57) ABSTRACT

In an image generating apparatus, a push-up member for pushing up a paper and bringing the same into contact with a paper feed roller includes a first push-up member, a second push-up member and a torsion coil spring, a second engaging portion of the second push-up member is rotatably engaged with a first engaging portion of the first push-up member, a second spring engaging portion of the second push-up member is engaged with a coil portion of the torsion coil spring, and a first spring engaging portion of the first push-up member is engaged with a first arm portion of the torsion coil spring.

12 Claims, 11 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a push-up member for pushing up a paper and bringing the same into contact with a paper feed roller.

2. Description of the Background Art

In general, a feeder comprising a push-up member for pressing a paper against a paper feed roller carrying the same in a paper feed direction is known as a feeder employed for an image generating apparatus such as a dye sublimation printer, as disclosed in Japanese Patent Laying-Open Nos. 5-132194 (1993) and 6-286265 (1994), Japanese Examined Utility Model Publication No. 7-41717 (1995) and Japanese Patent No. 2740215, for example.

The aforementioned Japanese Patent Laying-Open No. 5-132194 discloses a feeder comprising a movable press plate (push-up member) for pressing bulk of manuscript (papers) against a drive roller (paper feed roller), a drive member for swinging and rotating the movable press plate, a spring supported by the drive member, a press motor provided outside of a chassis, a round shaft shaped swing shaft transmitting driving force of the press motor to the movable press plate and supported by a bearing provided in the chassis. This feeder is formed such that the swing shaft rotates following to drive and rotation of the press motor and the drive member fixed to the swing shaft through a screw or the like is swung. The movable press plate is swung and rotated through the spring supported by the drive member.

The aforementioned Japanese Patent Laying-Open No. 6-286265 discloses a printer (image generating apparatus) comprising an interlocking mechanism constituted by a plurality of members pressing a front feeding table (push-up member) against a pickup roller (paper feed roller) with proper prescribed pressing force for feeding. This interlocking mechanism comprises a stay having a first end rotatably mounted on the front feeding table with a locking pin, a first arm, a round shaft shaped pressing fulcrum shaft rotatably mounted with a second end of the stay and a first end of the first arm with locking pins, and a second arm having a first end screwed on a second end of the first arm.

The aforementioned Japanese Examined Utility Model Publication No. 7-41717 discloses a feeder comprising a press plate (push-up member) pressing a single sheet (paper) against a paper feed roller, a guide plate fixed to a housing, a round shaft shaped shaft provided in the guide plate and rotatably supporting the press plate, a torsion coil spring urging the press plate toward the paper feed roller. The press plate of the feeder is so formed as to gradually rotate toward the paper feed roller with the urging force of the torsion coil spring as the number of the single sheets is reduced.

The aforementioned Japanese Patent No. 2740215 discloses a thermal transfer recording apparatus comprising a knock up arm (first push-up member) pressing a recording paper (paper) against a pickup roller (paper feed roller), a knock up arm bracket (second push-up member) capable of rotating due to a rotating shaft capable of rotating with a motor, and a torsion coil spring rotatably supporting the knock up arm and the knock up arm bracket. The thermal transfer recording apparatus is so formed that the torsion coil spring and the knock up arm connected to the knock up arm bracket is rotated by rotation of the round shaft shaped rotating shaft fixed to the knock up arm bracket with the motor.

Thus, the knock up arm is so formed as to press a sheet placing plate with the recording papers stacked thereon.

The feeder disclosed in the aforementioned Japanese Patent Laying-Open No. 5-132194, however, is provided with the round shaft shaped swing shaft connecting the press motor the drive member in order to drive the movable press plate, and therefore the round shaft shaped swing shaft (rotating shaft) requiring machining time in order to rotate the movable press plate must be disadvantageously separately provided.

The printer (image generating apparatus) disclosed in the aforementioned Japanese Patent Laying-Open No. 6-286265 is provided with the stay of the interlocking mechanism pressing the front feeding table (push-up member) against the pickup roller (paper feed roller) with the proper prescribed pressing force feeding and the round shaft shaped pressing fulcrum shaft rotatably supporting the first arm, and therefore the round shaft shaped pressing fulcrum shaft (rotating shaft) requiring machining time in order to press the front feeding table against the pickup roller must be disadvantageously separately provided.

The feeder disclosed in the aforementioned Japanese Examined Utility Model Publication No. 7-41717 is provided with the round shaft shaped shaft rotatably supporting the press plate in order to rotate the press plate (push-up member), and therefore the round shaft shaped shaft (rotating shaft) requiring machining time in order to rotate the press plate must be disadvantageously separately provided.

The thermal transfer recording apparatus disclosed in the aforementioned Japanese Patent No. 2740215 is provided with the round shaft shaped rotating shaft connecting the motor and the knock up arm bracket (second push-up member), the round shaft shaped rotating shaft requiring machining time in order to rotate the knock up arm bracket must be disadvantageously separately provided.

SUMMARY OF THE INVENTION

The present invention has been proposed in order to solve the aforementioned problem, and an object of the present invention is to provide an image generating apparatus capable of pushing up a paper without separately providing a round shaft shaped rotating shaft in order to rotate a push-up member.

In order to attain the aforementioned object, an image generating apparatus according to a first aspect of the present invention comprises a paper feed roller carrying a paper in a paper feed direction, a push-up member for pushing up the paper and bringing the same into contact with the paper feed roller, and a chassis on which the paper feed roller and the push-up member are arranged, wherein the push-up member includes a first push-up member integrally having a paper support portion supporting the paper, a first engaging portion and a first spring engaging portion, and a tabular second push-up member engaged with the first push-up member and integrally having a rotating shaft portion rotatably engaged with the chassis, a second engaging portion and a second spring engaging portion, and a torsion coil spring engaged with the first push-up member and the second push-up member and having a coil portion and a first arm portion provided on a first end of the coil portion, the second engaging portion of the second push-up member is rotatably engaged with the first engaging portion of the first push-up member, the second spring engaging portion of the second push-up member is engaged with the coil portion of the torsion coil spring, and the first spring-engaging portion of the first push-up member is engaged with the first arm portion of the torsion coil spring.

In the image generating apparatus according to the first aspect, as hereinabove described, the push-up member includes the first push-up member having the paper support portion supporting the paper, the first engaging portion and the first spring engaging portion, and the tabular second push-up member engaged with the first push-up member and integrally having the rotating shaft portion rotatably engaged with the chassis, whereby a round shaft shaped rotating shaft requiring machining time in order to rotate the second push-up member with respect to the chassis may not be separately provided. The first engaging portion of the first push-up member is rotatably engaged with the second engaging portion of the second push-up member, whereby the first push-up member can be rotated about the second engaging portion of the second push-up member without using the round shaft shaped rotating shaft. Thus, the round shaft shaped rotating shaft may not be separately provided in order to rotate the first push-up member. Consequently, the paper can be pushed up without separately providing the round shaft shaped rotating shaft in order to rotate the push-up member (first and second push-up members). The second spring engaging portion of the second push-up member is engaged with the coil portion of the torsion coil spring and the first spring engaging portion of the first push-up member is engaged with the first arm portion of the torsion coil spring, whereby the first push-up member pushes up the paper and the torsion coil spring engaged with the second spring engaging portion of the second push-up member urges the first push-up member when the first engaging portion of the first push-up member rotates with respect to the second engaging portion of the second push-up member. Thus, even when the number of the papers varies, the paper can be pressed against the paper feed roller with the proper pressure through deflection of the torsion coil spring in response to the number of the papers.

In the aforementioned image generating apparatus according to the first aspect, the first engaging portion of the first push-up member preferably includes an engaging pawl extending in the paper feed direction, and the second engaging portion of the second push-up member preferably includes an engaging hole capable of receiving the engaging pawl and having a length smaller than the length in the paper feed direction of the engaging pawl. According to this structure, the engaging hole of the second push-up member and the engaging pawl of the first push-up member can be unlikely to disengage with each other.

In this case, the engaging hole preferably includes a first engaging hole portion and a second engaging hole portion provided continuous to each other, the first engaging hole portion is preferably provided on a first side in the paper feed direction of the first engaging hole portion and includes a first engaging surface engaged with a first engaging surface of a the engaging pawl, the second engaging hole portion is preferably provided on a second side in the paper feed direction of the engaging hole diagonally to the first engaging surface, and includes a second engaging surface engaged with a second engaging surface of the engaging pawl, and the lengths in the paper feed direction of the first engaging hole portion and the second engaging hole portion are preferably larger than the thickness of the engaging pawl, and the interval in the paper feed direction between the first engaging surface and the second engaging surface is substantially equal to the thickness of the engaging pawl. According to this structure, a portion of the engaging pawl, having the length in paper feed direction longer than the thicknesses of the first engaging hole portion and the second engaging hole portion is utilized when the engaging pawl of the first push-up member is engaged with the engaging hole of the second push-up member (first and second engaging hole portions), so that the engaging pawl can be easily inserted into the first and second engaging hole portions, and after the insertion, the first and second engaging surfaces having the interval in the paper feed direction therebetween substantially equal to the thickness of the engaging pawl is brought into contact with the first and second engaging surfaces of the engaging pawl, so that the engaging pawl of the first push-up member and the engaging hole of the second push-up member can be easily engaged with each other.

In the aforementioned image generating apparatus according to the first aspect, the second spring engaging portion of the second push-up member preferably includes a stop portion for inhibiting engaged the coil portion of the torsion coil spring from moving toward a first side in a direction intersecting with the paper feed direction of the paper, and the first arm portion of the torsion coil spring is preferably so engaged with the first spring engaging portion as to urge the first spring engaging portion of the first push-up member upward and toward a second side in the direction intersecting with the paper feed direction of the paper. According to this structure, the first arm portion of the torsion coil spring engaging with the second push-up member urges the first spring engaging portion of the first push-up member upward, so that the first push-up member can be easily rotated upward following upward rotation of the second push-up member. Thus, the first push-up member can easily push up the paper and urge the same against the paper feed roller. The first arm portion of the torsion coil spring urges the first spring engaging portion of the first push-up member toward the second side in the direction intersecting with the paper feed direction, whereby the engaging pawl of the first engaging portion of the first push-up member can be pressed against the first and second engaging surfaces of the engaging hole of the second engaging portion. Thus, disengagement of the engaging pawl from the engaging hole can be effectively suppressed.

In this case, the first spring engaging portion is preferably so formed as to extend upward and bend toward the first side in the direction intersecting with the paper feed direction of the paper. According to this structure, the portion extending upward in the first spring engaging portion can receive the urging force of the first arm portion of the torsion coil spring in the direction intersecting with the paper feed direction of the paper, and the portion bending toward the first side in the direction intersecting with the paper feed direction of the paper in the first spring engaging portion can receive the urging force of the first engaging arm portion of the torsion coil spring in a vertical direction.

In the aforementioned image generating apparatus according to the first aspect, the torsion coil spring preferably further includes a second arm portion provided on a second end of the coil portion of the torsion coil spring and locked by the second spring engaging portion. According to this structure, the second arm portion can inhibit the coil portion of the torsion coil spring from rotating around the second spring engaging portion in an idling manner.

The aforementioned image generating apparatus according to the first aspect preferably further comprises an apparatus body including the paper feed roller, the push-up member and the chassis, wherein the apparatus body is preferably detachably mounted with a paper cassette, the paper cassette preferably includes a press plate arranged above the paper support portion of the first push-up member and arranged with the paper on an upper surface so as to come into surface contact with a prescribed range closer to the first push-up member of the paper, in a state of mounting the paper cassette on the apparatus body, and the paper is preferably lifted up by the paper support portion of the first push-up member through the press plate, and comes into contact with the paper feed roller. According to this structure, the paper can be brought into contact with the paper feed roller in a state of coming into surface contact with the press plate, whereby the paper can be stably brought into contact with the paper feed roller.

In the aforementioned image generating apparatus in which the paper cassette is detachably mounted on the apparatus body, the first push-up member and the second push-up member are preferably formed such that the first engaging portion of the first push-up member is capable of rotating downward with respect to the second engaging portion of the second push-up member when the paper support portion of the first push-up member lifts up the press plate of the paper cassette and the paper comes into contact with the paper feed roller. According to this structure, force for bringing the paper into contact with the paper feed roller can be inhibited from becoming larger than prescribed force, whereby the paper brought into contact with the paper feed roller can be inhibited from being damaged.

In this case, the torsion coil spring is preferably so formed as to urge the first engaging portion of the first push-up member upward when the paper support portion of the first push-up member lifts up the press plate of the paper cassette and the paper comes into contact with the paper feed roller. According to this structure, the paper can be easily brought into contact with the paper feed roller with the torsion coil spring through prescribed force.

An image generating apparatus according to a second aspect of the present invention comprises a paper feed roller carrying a paper in a paper feed direction, a push-up member for pushing up the paper and bringing the same into contact with the paper feed roller, and a chassis on which the paper feed roller and the push-up member are arranged, wherein the push-up member includes a first push-up member integrally having a paper support portion supporting the paper, a first engaging portion and a first spring engaging portion, and a tabular second push-up member engaged with the first push-up member and integrally having a rotating shaft portion rotatably engaged with the chassis, a second engaging portion and a second spring engaging portion, and a torsion coil spring engaged with the first push-up member and the second push-up member and having a coil portion and a first arm portion provided on a first end of the coil portion, the second engaging portion of the second push-up member is rotatably engaged with the first engaging portion of the first push-up member, the second spring engaging portion of the second push-up member is engaged with the coil portion of the torsion coil spring, the first spring engaging portion of the first push-up member is engaged with the first arm portion of the torsion coil spring, the first engaging portion of the first push-up member includes an engaging pawl extending in the paper feed direction, the second engaging portion of the second push-up member includes an engaging hole capable of receiving the engaging pawl and having a length smaller than the length in the paper feed direction of the engaging pawl, the second spring engaging portion of the second push-up member includes a stop portion for inhibiting engaged the coil portion of the torsion coil spring from moving toward a first side in a direction intersecting with the paper feed direction of the paper, the first arm portion of the torsion coil spring is so engaged with the first spring engaging portion as to urge the first spring engaging portion of the first push-up member upward and toward a second side in the direction intersecting with the paper feed direction of the paper, the first spring engaging portion of the first push-up member is so formed as to extend upward and bend toward the first side in the direction intersecting with the paper feed direction of the paper, and the torsion coil spring further includes a second arm portion provided on a second end of the coil portion of the torsion coil spring and locked by the second spring engaging portion.

In the image generating apparatus according to the second aspect of the present invention, as hereinabove described, the push-up member includes the first push-up member having the paper support portion supporting the paper, the first engaging portion and the first spring engaging portion, and the tabular second push-up member engaged with the first push-up member and integrally having the rotating shaft portion rotatably engaged with the chassis, whereby a round shaft shaped rotating shaft requiring machining time in order to rotate the second push-up member with respect to the chassis may not be separately provided. The first engaging portion of the first push-up member is rotatably engaged with the second engaging portion of the second push-up member, whereby the first push-up member can be rotated about the second engaging portion of the second push-up member without using the round shaft shaped rotating shaft. Thus, the round shaft shaped rotating shaft may not be separately provided in order to rotate the first push-up member. Consequently, the paper can be pushed up without separately providing the round shaft shaped rotating shaft in order to rotate the push-up member (first and second push-up members). The second spring engaging portion of the second push-up member is engaged with the coil portion of the torsion coil spring and the first spring engaging portion of the first push-up member is engaged with the first arm portion of the torsion coil spring, whereby the first push-up member pushes up the paper and the torsion coil spring engaged with the second spring engaging portion of the second push-up member urges the first push-up member when the first engaging portion of the first push-up member rotates with respect to the second engaging portion of the second push-up member. Thus, even when the number of the papers varies, the paper can be pressed against the paper feed roller with the proper pressure through deflection of the torsion coil spring in response to the number of the papers.

In the image generating apparatus according to the second aspect, the first engaging portion of the first push-up member includes the engaging pawl extending in the paper feed direction, and the second engaging portion of the second push-up member includes the engaging hole capable of receiving the engaging pawl and having the length smaller than the length in the paper feed direction of the engaging pawl, whereby the engaging hole of the second push-up member and the engaging pawl of the first push-up member can be unlikely to disengage with each other. The stop portion for inhibiting engaged the coil portion of the torsion coil spring from moving toward the first side in the direction intersecting with the paper feed direction of the paper is provided in the second spring engaging portion of the second push-up member, and the first arm portion of the torsion coil spring is so engaged with the first spring engaging portion as to urge the first spring engaging portion of the first push-up member upward and toward the second side in the direction intersecting with the paper feed direction of the paper, whereby the first arm portion of the torsion coil spring engaging with the second push-up member urges the first spring engaging portion of the first push-up member upward, so that the first push-up member can be easily rotated upward following upward rotation of the second push-up member. Thus, the first push-up member can easily push up the paper and urge the same against the paper feed roller. The first arm portion of the torsion coil spring urges the first spring engaging portion of the first push-up member toward the second side in the direction intersecting with the paper feed direction, whereby the engaging pawl of the first engaging portion of the first push-up member can be pressed against the first and second engaging surfaces of the engaging hole of the second engaging portion. Thus, disengagement of the engaging pawl from the engaging hole can be effectively suppressed. The first spring engaging portion is so formed as to extend upward and bend toward the first side in the direction intersecting with the paper feed direction of the paper, whereby the portion extending upward in the first spring engaging portion can receive the urging force of the first arm portion of the torsion coil spring in the direction intersecting with the paper feed direction of the paper, and the portion bending toward the first side in the direction intersecting with the paper feed direction of the paper in the first spring engaging portion can receive the urging force of the first engaging arm portion of the torsion coil spring in a vertical direction. The second arm portion locked by the second spring engaging portion is provided on the second end of the coil portion of the torsion coil spring, whereby the second arm portion can inhibit the coil portion of the torsion coil spring from rotating around the second spring engaging portion in an idling manner.

In the aforementioned image generating apparatus according to the second aspect, the engaging hole preferably includes a first engaging hole portion and a second engaging hole portion provided continuous to each other, the first engaging hole portion is preferably provided on a first side in the paper feed direction of the first engaging hole portion and preferably includes a first engaging surface engaged with a first engaging surface of the engaging pawl, the second engaging hole portion is preferably provided on a second side in the paper feed direction of the engaging hole diagonally to the first engaging surface and preferably includes a second engaging surface engaged with a second engaging surface of the engaging pawl, and the lengths in the paper feed direction of the first engaging hole portion and the second engaging hole portion are preferably larger than the thickness of the engaging pawl, and the interval in the paper feed direction between the first engaging surface and the second engaging surface is substantially equal to the thickness of the engaging pawl. According to this structure, a portion of the engaging pawl, having the length in paper feed direction longer than the thicknesses of the first engaging hole portion and the second engaging hole portion is utilized when the engaging pawl of the first push-up member is engaged with the engaging hole of the second push-up member (first and second engaging hole portions), so that the engaging pawl can be easily inserted into the first and second engaging hole portions, and after the insertion, the first and second engaging surfaces having the interval in the paper feed direction therebetween substantially equal to the thickness of the engaging pawl is brought into contact with the first and second engaging surfaces of the engaging pawl, so that the engaging pawl of the first push-up member and the engaging hole of the second push-up member can be easily engaged with each other.

The aforementioned image generating apparatus according to the second aspect preferably further comprises an apparatus body including the paper feed roller, the push-up member and the chassis, wherein the apparatus body is preferably detachably mounted with a paper cassette, the paper cassette preferably includes a press plate arranged above the paper support portion of the first push-up member and arranged with the paper on an upper surface so as to come into surface contact with a prescribed range closer to the first push-up member of the paper, in a state of mounting the paper cassette on the apparatus body, and the paper is preferably lifted up by the paper support portion of the first push-up member through the press plate, and comes into contact with the paper feed roller. According to this structure, the paper can be brought into contact with the paper feed roller in a state of coming into surface contact with the press plate, whereby the paper can be stably brought into contact with the paper feed roller.

In the aforementioned image generating apparatus in which the paper cassette is detachably mounted on the apparatus body, the first push-up member and the second push-up member are preferably formed such that the first engaging portion of the first push-up member is capable of rotating downward with respect to the second engaging portion of the second push-up member when the paper support portion of the first push-up member lifts up the press plate of the paper cassette and the paper comes into contact with the paper feed roller. According to this structure, force for bringing the paper into contact with the paper feed roller can be inhibited from becoming larger than prescribed force, whereby the paper brought into contact with the paper feed roller can be inhibited from being damaged.

In this case, the torsion coil spring is preferably so formed as to urge the first engaging portion of the first push-up member upward when the paper support portion of the first push-up member lifts up the press plate of the paper cassette and the paper comes into contact with the paper feed roller. According to this structure, the paper can be easily brought into contact with the paper feed roller with the torsion coil spring through prescribed force.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be hereinafter described with reference to the drawings.

First, a structure of a dye sublimation printer according to the embodiment of the present invention will be described with reference to FIGS. 1 to 15. The embodiment of the present invention is applied to the dye sublimation printer, which is an exemplary image generating apparatus.

Figure 1:
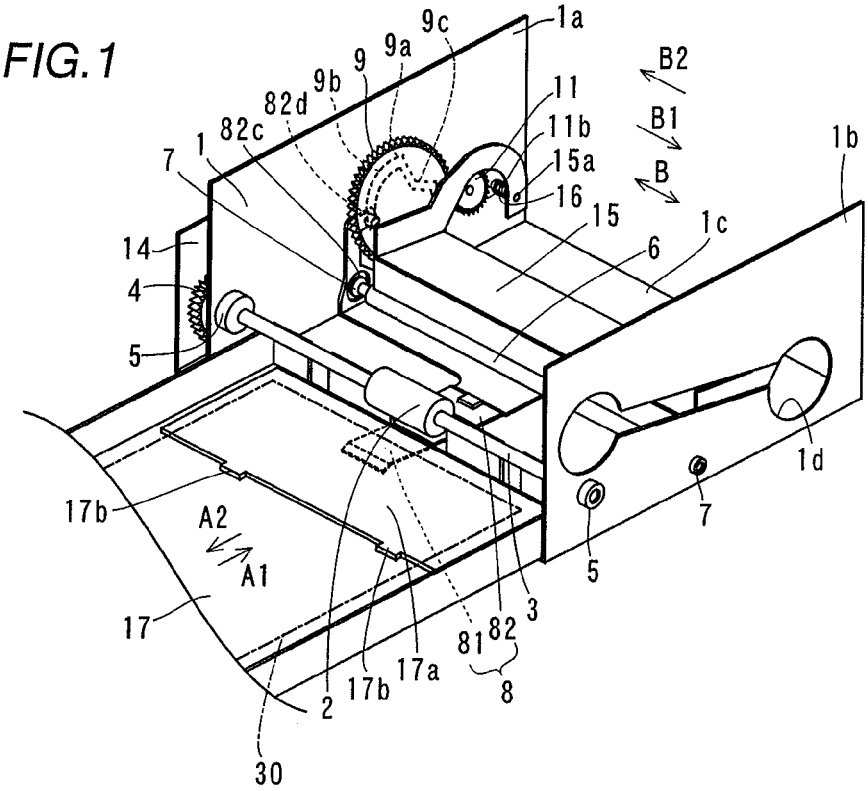
FIGS. 1 and 2 are perspective views showing a structure of a dye sublimation printer according to an embodiment of the present invention.
Figure 2:
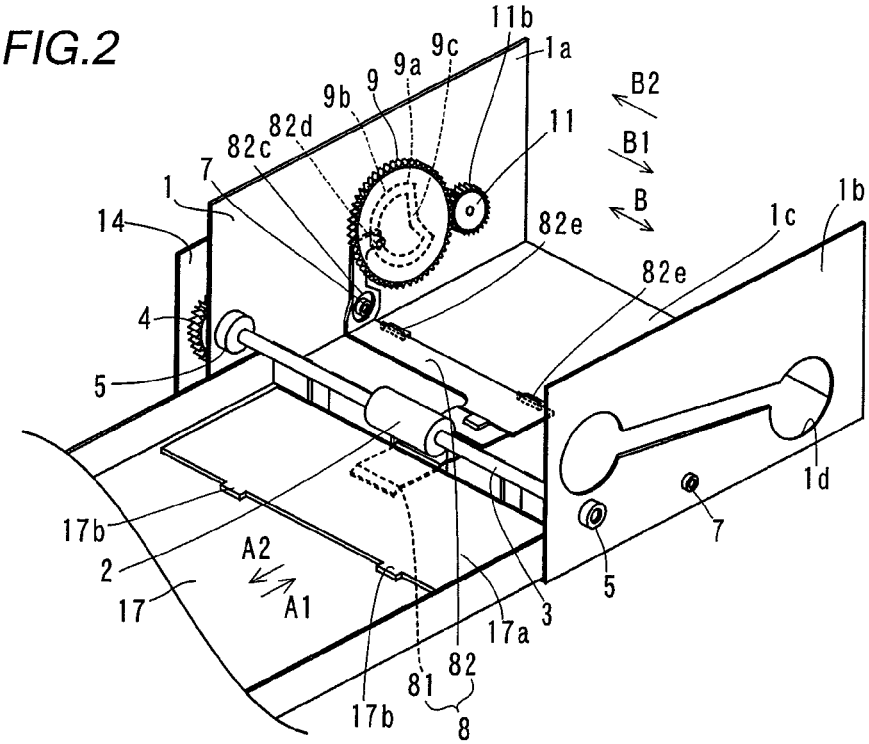

As shown in FIGS. 1 to 4, the dye sublimation printer according to the embodiment of the present invention comprises a chassis 1 of sheet metal, a paper feed roller 2 of rubber for feeding papers 30, a paper feed roller shaft 3 on which the paper feed roller 2 is mounted, a paper feed roller gear 4 for rotating the paper feed roller shaft 3, paper feed roller bearings 5, a platen roller 6 against which each of the papers 30 is pressed in printing, platen roller bearings 7, a tabular push-up member 8 of metal (sheet metal) for pressing each of the papers 30 against the paper feed roller 2, a drive gear 9, a motor 10 (see FIG. 3) serving as a drive source for driving the drive gear 9, an intermediate gear 11 (see FIG. 3) for transmitting the driving force of the motor 10 to the drive gear 9, another motor 12 (see FIG. 3) serving as a drive source for driving the paper feed roller 2, a plurality of intermediate gears 13 (see FIG. 3) for transmitting the driving force of the motor 12 to the paper feed roller gear 4, a motor bracket 14 of metal on which the motors 10 and 12 are mounted, a thermal head 15 (see FIG. 1) and a torsion coil spring 16 urging the thermal head 15 away from the platen roller 6. A paper feed cassette 17 storing the papers 30 is detachably mounted on the dye sublimation printer, as shown in FIGS. 1 and 2.

Figure 3:
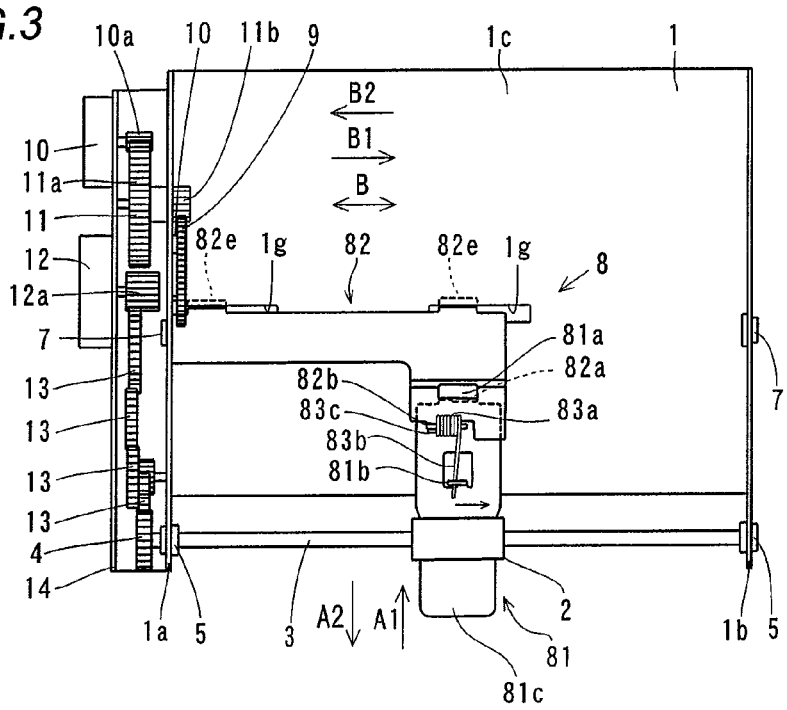
FIG. 3 is a plan view showing the structure of the dye sublimation printer according to the embodiment of the present invention.
Figure 4:
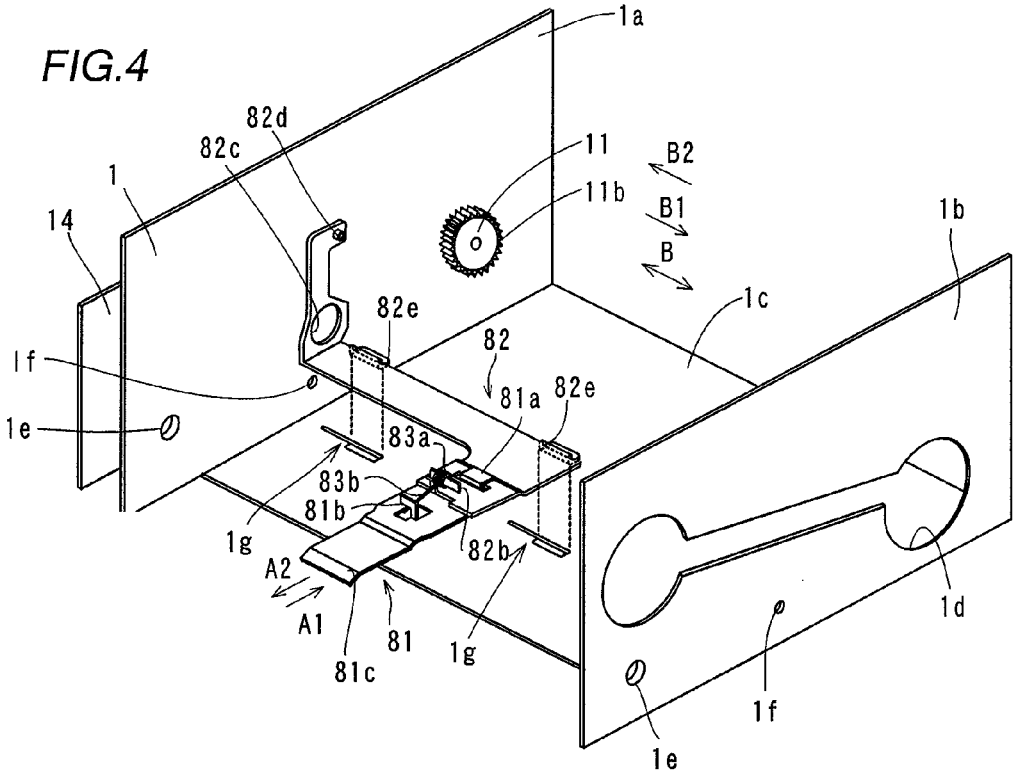
FIG. 4 is a perspective view showing the structure of the dye sublimation printer according to the embodiment of the present invention.

The chassis 1 has a first side surface 1*a* on which the motor bracket 14 is mounted, a second side surface 1*b* and a bottom surface 1*c* connecting the first and second side surfaces 1*a* and 1*b* with each other, as shown in FIGS. 1 to 4. The second side surface 1*b* of the chassis 1 is provided with an ink sheet cartridge receiving hole 1*d* for receiving an ink sheet cartridge (not shown) storing an ink sheet. The first and second side surfaces 1*a* and 1*b* of the chassis 1 are provided with paper feed roller bearing mounting holes 1*e* and platen roller bearing mounting holes 1*f* respectively, as shown in FIG. 4. As shown in FIGS. 1 to 3, the paper feed roller bearings 5 rotatably supporting both ends of the paper feed roller 2 are mounted on the paper feed roller bearing mounting holes 1*e* of the first and second side surfaces 1*a* and 1*b* of the chassis 1. The platen roller bearings 7 rotatably supporting both ends of the platen roller 6 are mounted on the platen roller bearing mounting holes 1*f* of the first and second side surfaces 1*a* and 1*b* of the chassis 1. The bottom surface 1*c* of the chassis 1 is provided with a pair of holes 1*g* for rotatably mounting the push-up member 8, as shown in FIGS. 3 and 4.

The paper feed roller 2 is arranged above a press plate 17*a* of the paper cassette 17, as shown in FIGS. 1 and 2. This paper feed roller 2 is so formed as to carry the papers 30 in a paper feed direction (along arrow A1) through rotation. As shown in FIGS. 1 to 3, the paper feed roller 2 is mounted in the vicinity of the central portion of the paper feed roller shaft 3. The paper feed roller bearings 5 mounted on the first and second side surfaces 1*a* and 1*b* of the chassis 1 rotatably support both ends of the paper feed roller shaft 3. The paper feed roller gear 4 is mounted on an end of the paper feed roller shaft 3 closer to the first side surface 1*a* in an unidling manner. The plurality of intermediate gears 13 engage with the paper feed roller gear 4, as shown in FIG. 3. The plurality of intermediate gears 13 are so arranged as to engage with a motor gear 12*a* of the motor 12.

According to the embodiment, the push-up member 8 of metal (sheet metal) has a tabular first push-up member 81 pressing each of the papers 30 (see FIGS. 1 and 2) against the paper feed roller 2 (see FIGS. 1 and 2) by pushing up the lower surface of the press plate 17*a* (see FIGS. 1 and 2) of the paper cassette 17 (see FIGS. 1 and 2) described later, a tabular second push-up member 82 on which the first push-up member 81 is rotatably mounted and a torsion coil spring 83 holding the first push-up member 81 with respect to the second push-up member 82 in a state of having prescribed urging force, as shown in FIGS. 5 to 8.

According to the embodiment, the first push-up member 81 has a thickness t1 (about 0.8 mm) (see FIGS. 6 and 8), and integrally includes an engaging pawl 81*a* engaging with an engaging hole 82*a* of the second push-up member 82, a spring engaging portion 81*b* and a pressing portion 81*c* pressing a lower surface of the press plate 17*a* (see FIGS. 1 and 2) as shown in FIGS. 5 to 9. The engaging pawl 81*a* is an example of the "first engaging portion" in the present invention, the spring engaging portion 81*b* is an example of the "first spring engaging portion" in the present invention. The pressing portion 81*c* is an example of the "paper support portion" in the present invention. The second push-up member 82 has a thickness t2 (about 1 mm) (see FIGS. 6 and 8) and integrally includes an engaging hole 82*a* receiving the engaging pawl 81*a* of the first push-up member 81, a spring engaging portion 82*b*, a receiving hole 82*c* receiving the platen roller bearing 7, a cam engaging portion 82*d* engaging with an after-mentioned cam groove 9*a* (see FIGS. 1 and 2) of the drive gear 9, a pair of rotating shaft portions 82*e* engaging with a pair of holes 1*g* respectively, as shown in FIGS. 5 to 8 and 11. The engaging hole 82*a* is an example of the "second engaging portion" in the present invention, the spring engaging portion 82*b* is an example of the "second spring engaging portion" in the present invention.

Figure 6:
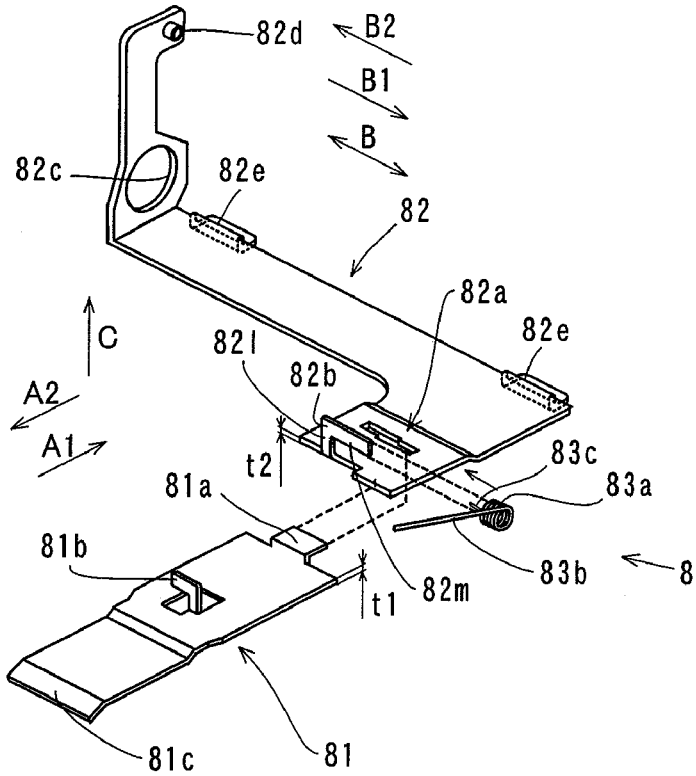
FIG. 6 is an exploded perspective view of the push-up member according to the embodiment of the present invention.
Figure 7:
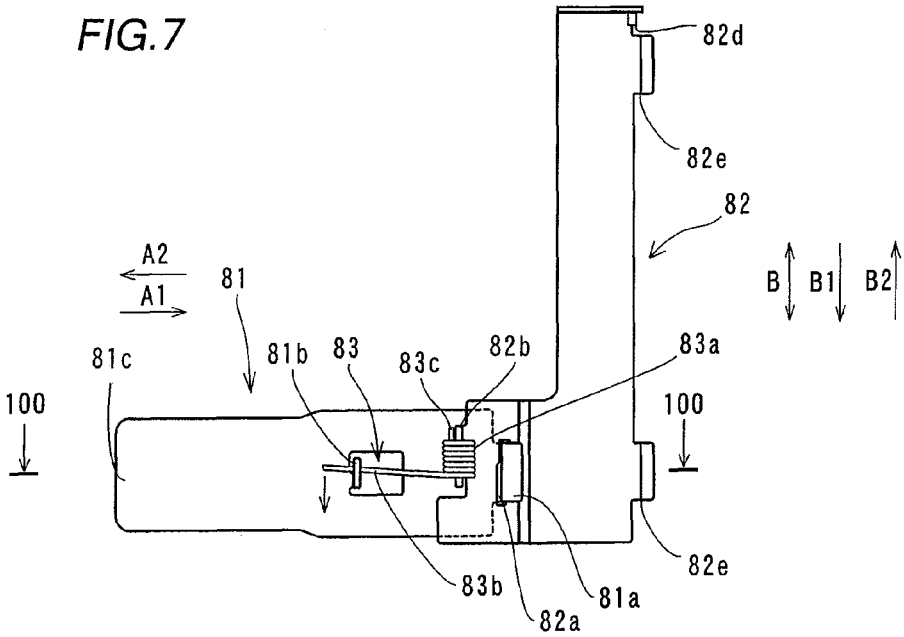
FIG. 7 is a plan view of the push-up member according to the embodiment of the present invention.
Figure 8:
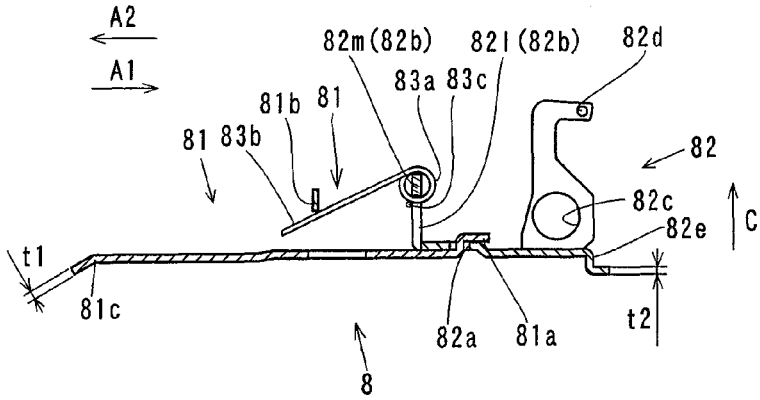
FIG. 8 is a sectional view taken along the line 100-100 in FIG. 7.

According to the embodiment, the engaging pawl 81*a* of the first push-up member 81 is provided in the vicinity of the central portion in a direction substantially perpendicular to a paper feed direction (along arrow B) of the first push-up member 81 as shown in FIGS. 5 to 9. As shown in FIG. 8, the engaging pawl 81*a* is provided with a step upward (along arrow C) by the thickness t2 of the second push-up member 82 and is so formed as to extend in the paper feed direction (along arrow A1). The width in the direction substantially perpendicular to the paper feed direction (along arrow B) of the engaging pawl 81*a*, in other words, the width between first and second side surfaces 81*d* and 81*e* is formed so as to be W1 (see FIG. 9). The engaging pawl 81*a* has the length L1 in the paper feed direction (along arrow A1).

Figure 10:
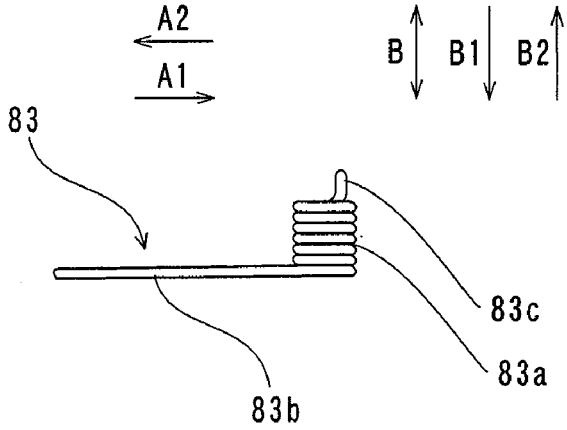
FIG. 10 is a plan view showing a torsion coil spring according to the embodiment of the present invention.
Figure 11:
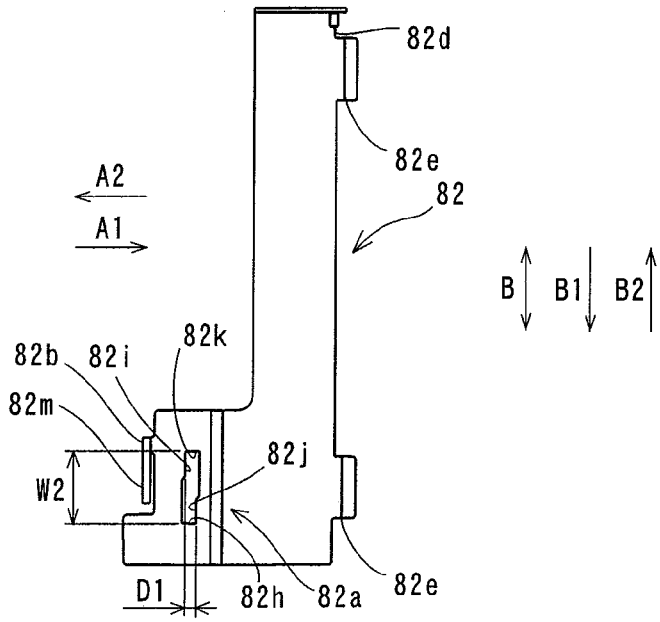
FIG. 11 is a plan view showing a second push-up member of the push-up member according to the embodiment of the present invention.
Figure 12:
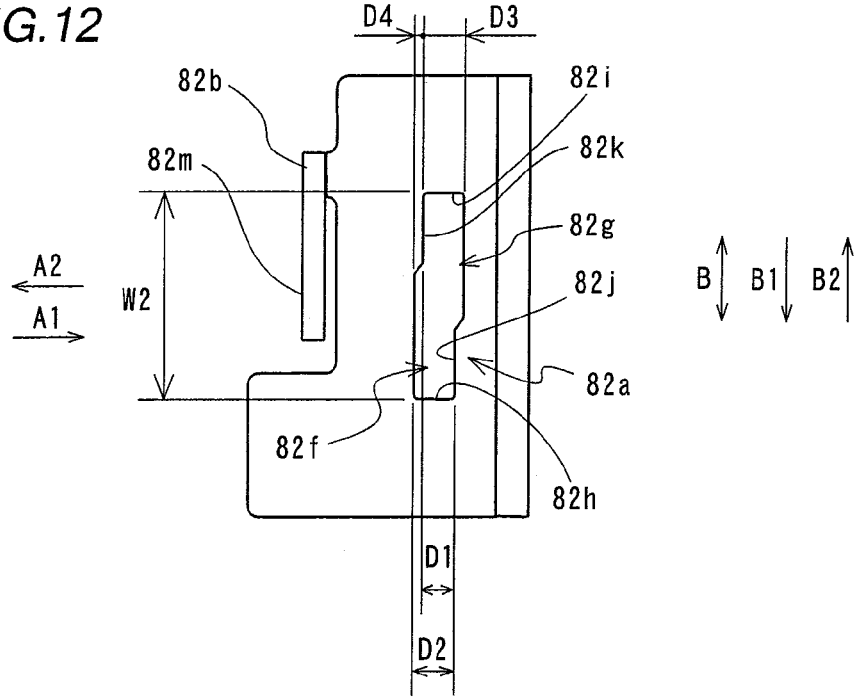
FIG. 12 is a diagram for illustrating a structure of the push-up member of the dye sublimation printer according to the embodiment of the present invention.

According to the embodiment, the spring engaging portion 81*b* of the first push-up member 81 is so formed as to extend upward (along arrow C) and be bent toward a first side (along arrow B2) in the direction substantially perpendicular to the paper feed direction (along arrow B) as shown in FIGS. 6, 8 and 10.

According to the embodiment, the engaging hole 82*a* of the second push-up member 82 is provided at a position corresponding to the engaging pawl 81*a* of the first push-up member 81, as shown in FIGS. 6, 7, 11 and 12. As shown in FIGS.

11 and 12, the width between an inner end surface 82*h* (surface along arrow B1) in the direction substantially perpendicular to the paper feed direction (along arrow B) of a first engaging hole portion 82*f* and an inner end surface 82*i* (surface along arrow B2) of a second engaging hole portion 82*g* is formed so as to be W2. The width W2 between the inner end surface 82*h* and the inner end surface 82*i* is slightly lager than the width W1 (see FIG. 9) between first side surfaces 81*d* and 81*e* (see FIG. 9) of the first push-up member 81. The second engaging hole portion 82*g* is formed at a position deviated by a distance D4 in the paper feed direction with respect to the first engaging hole portion 82*f*. The length D2 in the paper feed direction of the first engaging hole portion 82*f* and the length D3 in the paper feed direction of the second engaging hole portion 82*g* are formed as to be equal to each other and larger than the thickness t1 of the engaging pawl 81*a*. Thus, the engaging pawl 81*a* can be easily inserted into the engaging hole 82*a*. The distance between an engaging surface 82*j* in the paper feed direction (along arrow A1) of the first engaging hole portion 82*f* and an engaging surface 82*k* in a direction opposite to the paper feed direction (along arrow A2) of the second engaging hole portion 82*g* is formed so as to be D1. The engaging surface 82*j* is an example of the "first engaging surface" in the present invention, and the engaging surface 82*k* is an example of the "second engaging surface" in the present invention. The distance D1 between the engaging surfaces 82*j* and 82*k* is substantially equal in size to the thickness t1 (see FIGS. 6 and 8) of the engaging pawl 81*a* included in the first push-up member 81. Thus, in a case where the engaging pawl 81*a* is engaged with the engaging hole 82*a*, the first push-up member 81 can be inhibited from moving in the paper feed direction (along arrow A1) and the direction opposite to the paper feed direction (along arrow A2) with respect to the second push-up member 82.

Figure 5:
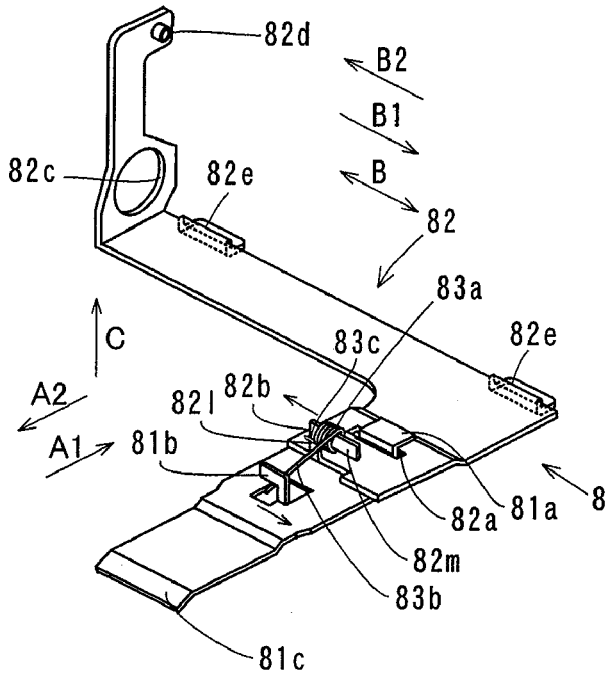
FIG. 5 is a perspective view of a push-up member according to the embodiment of the present invention.
Figure 9:
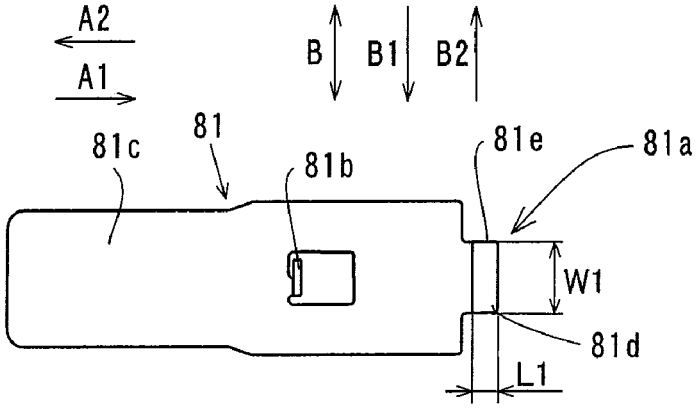
FIG. 9 is a plan view showing a first push-up member of the push-up member according to the embodiment of the present invention.

According to the embodiment, the spring engaging portion 82*b* of the second push-up member 82 includes the spring stop portion 82*l* extending upward (along arrow C) and a spring receiving portion 82*m* bending toward a second side (along arrow B1) in the direction substantially perpendicular to the paper feed direction (along arrow B) as shown in FIGS. 5, 6 and 9. The spring stop portion 82*l* is an example of the "stop portion" in the present invention.

According to the embodiment, the engaging pawl 81*a* of the first push-up member 81 is so formed as to rotatably engage with the engaging hole 82*a* of the second push-up member 82 as shown in FIGS. 5 to 8.

According to the embodiment, as shown in FIGS. 5 to 8 and 10, the torsion coil spring 83 is constituted by a coil portion 83*a* formed by winding a wire rod in coil form, an engaging arm portion 83*b* so formed as to substantially extend in a tangential direction with respect to the coil portion 83*a* from a first end of the coil portion 83*a*, a support arm portion 83*c* so formed as to bent the wire rod in a direction intersecting with a winding direction of the coil portion 83*a* (along arrow B2) from a second end of the coil portion 83*a*. The engaging arm portion 83*b* is an example of the "first arm portion" in the present invention, the support arm portion 83*c* is an example of the "second arm portion" in the present invention. The coil portion 83*a* is engaged with the spring engaging portion 82*b* of the second push-up member 82 by inserting the coil portion 83*a* around the spring engaging portion 82*b* from the second end of the coil portion 83*a*. Thus, the support arm portion 83*c* provided on the second end of the coil portion 83*a* is locked by a surface in the direction opposite to the paper feed direction (along arrow A2) of the spring stop portion 82*l* of the spring engaging portion 82*b*, whereby the torsion coil spring 83 can be inhibited from rotating about the spring engaging portion 82*b*. The engaging arm portion 83*b* is so engaged as to urge the spring engaging portion 81*b* of the first push-up member 81 upward (along arrow C) and toward the second end (along arrow B1) in the direction substantially perpendicular to the paper feed direction (along arrow B). Thus, the engaging pawl 81*a* of the first push-up member 81 presses the engaging surfaces 82*j* and 82*k* of the engaging hole 82*a* of the second push-up member 82 and the inner end surface 82*h*, whereby the engaging pawl 81*a* can be inhibited from moving in the paper feed direction (along arrow A1) and the direction opposite to the paper feed direction (along arrow A2) and in the direction substantially perpendicular to the paper feed direction (along arrow B).

According to this structure, the push-up member 8 has such a structure that the first push-up member 81 pushing up each of the papers 30 and bringing the same into contact with the paper feed roller 2 and the second push-up member 82 rotating about the pair of holes 1*g* rotatably engage with each other while the second push-up member 82 and the first push-up member 81 are connected to each other through the torsion coil spring 83. Also when the second push-up member 82 is rotated at the same angle for large and small numbers of papers 30 to be pushed up respectively, therefore, the push-up member 8 can press each of the papers 30 against the paper feed roller 2 with a proper pressure through deflection of the support arm portion 83*c* of the torsion coil spring 83 downward.

As shown in FIGS. 1 to 3, the drive gear 9 is mounted on the first side surface 1*a* of the chassis 1. As shown in FIG. 2, the cam groove 9*a* coming into contact with the cam engaging portion 82*d* of the second push-up member 82 is provided on a side (back surface) closer to the first side surface 1*a* of the drive gear 9. The cam groove 9*a* has a circular groove portion 9*b* and a concave groove portion 9*c*. When the drive gear 9 rotates while the cam engaging portion 82*d* of the second push-up member 82 engages with the circular groove portion 9*b* and the concave groove portion 9*c*, the second push-up member 82 rotates about the pair of rotating shaft portions 82*e*. As shown in FIG. 3, the motor 10 has a motor gear 10*a*. The intermediate gear 11, mounted on the first side surface 1*a* of the chassis 1, has a large-diameter gear portion 11*a* and a small-diameter gear portion 11*b*. The motor gear 10*a* and the large-diameter gear portion 11*a* of the intermediate gear 11 engage with each other, while the small-diameter gear portion 11*b* of the intermediate gear 11 engages with the drive gear 9. Therefore, the driving force of the motor 10 is transmitted to the push-up member 8 through three gears, i.e. the motor gear 10*a*, the intermediate gear 11 and the drive gear 9. As shown in FIG. 1, the thermal head 15, rotating about a support shaft 15*a*, has a function of printing images on the papers 30.

Figure 14:
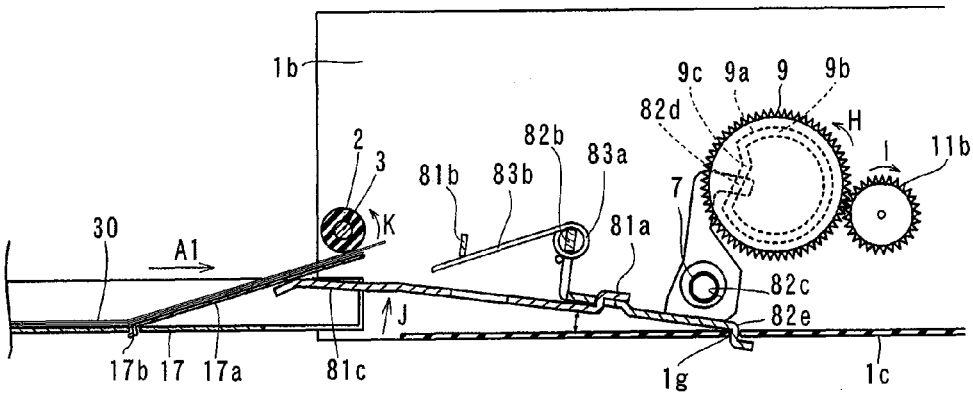
Figure 15:
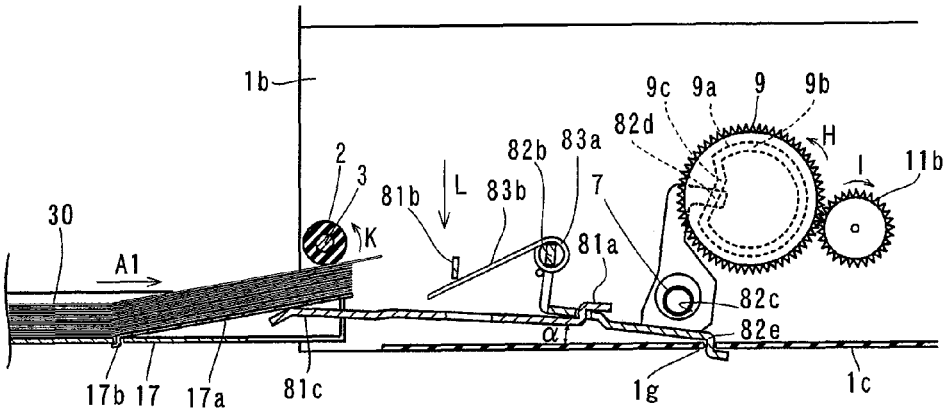

As shown in FIG. 2, the press plate 17*a* of resin is provided on a prescribed position of the paper cassette 17. This press plate 17*a* is so formed as to be rotatable about a fulcrum portion 17*b*. The papers 30 are loaded on an upper surface of the press plate 17*a* such that a range of a portion closer to the first push-up member 81 of the papers 30 comes into surface contact with the upper surface of the press plate 17*a*. Further, the press plate 17*a* is pushed up by the press portion 81*c* of the first push-up member 81 from the state shown in FIG. 13, thereby pressing each of papers 30 loaded on the press plate 17*a* against the paper feed roller 2, as shown in FIGS. 14 and 15.

FIGS. 16 to 22 are diagrams for illustrating a method of assembling the push-up member of the dye sublimation printer according to the embodiment of the present invention in detail. With reference to FIGS. 5, 7, and 16 to 22, the method of assembling the push-up member 8 of the dye sublimation printer according to the embodiment will be described.

Figure 16:
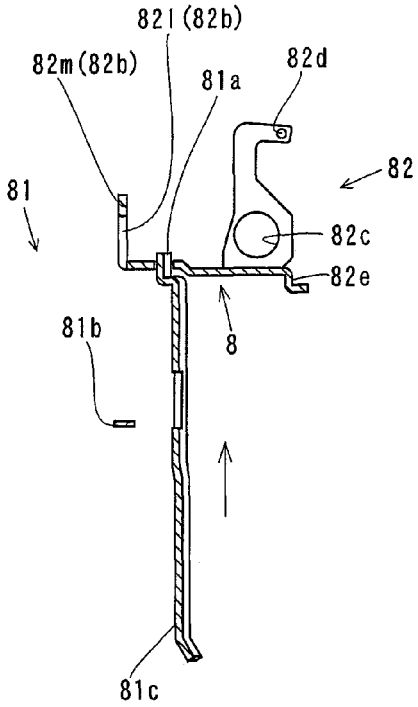
FIGS. 16 to 22 are diagrams for illustrating a method of assembling the push-up member of the dye sublimation printer according to the embodiment of the present invention in detail.
Figure 17:
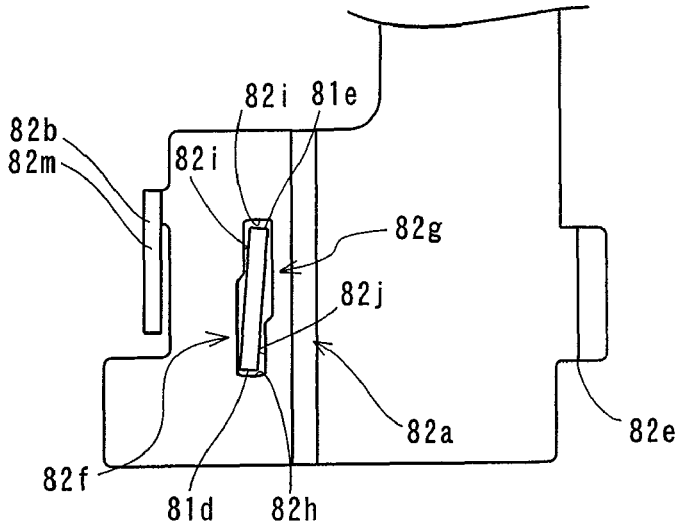
Figure 18:
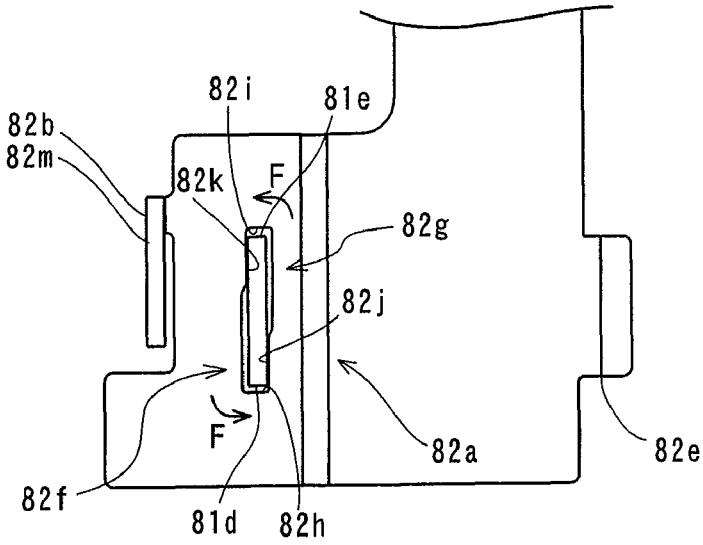
Figure 19:
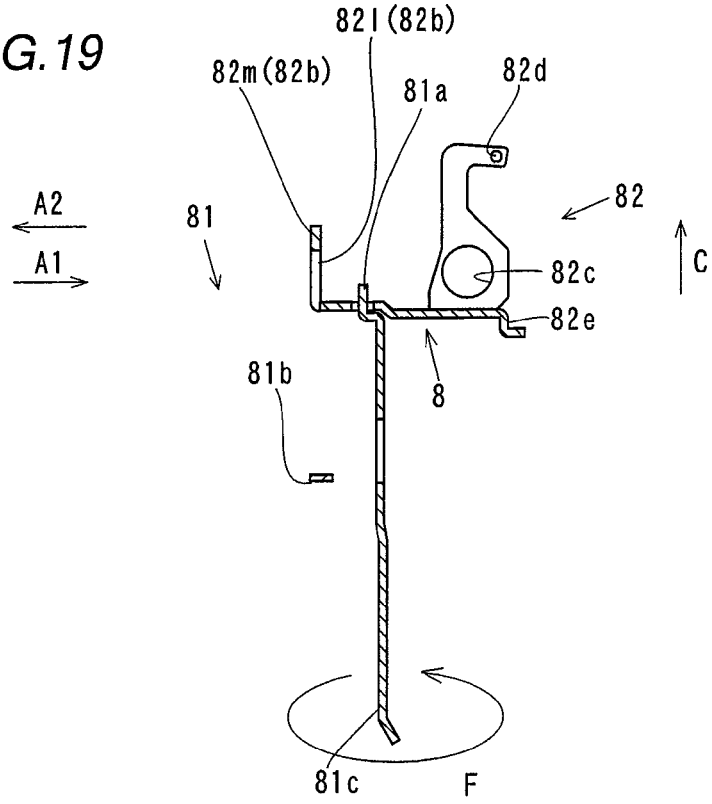
Figure 20:
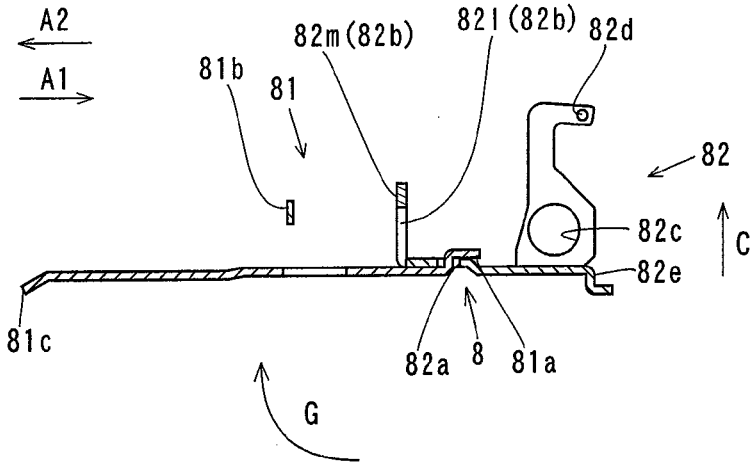
Figure 21:
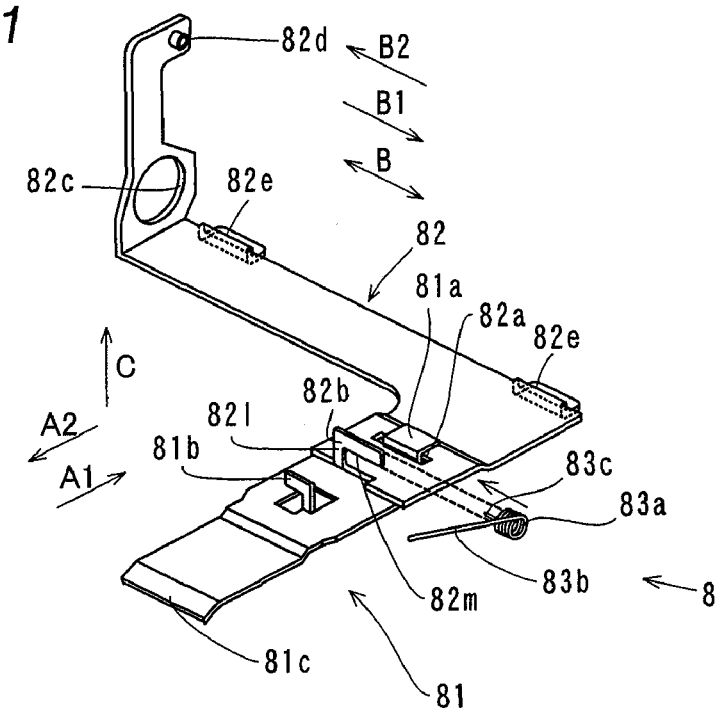
Figure 22:
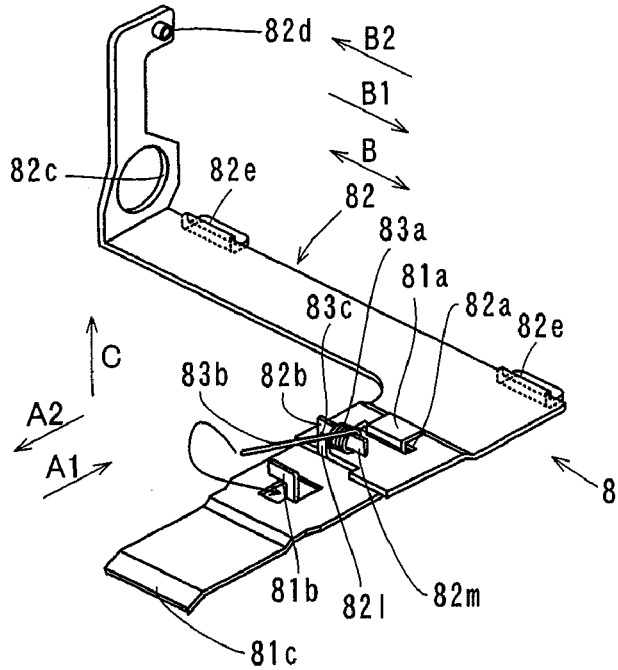

As shown in FIGS. 16 and 17, the engaging pawl 81*a* of the first push-up member 81 is inserted into the engaging hole 82*a* of the second push-up member 82 in a slightly oblique manner with respect to an extending direction of the engaging pawl 81*a*. As shown in FIGS. 18 and 19, the engaging pawl 81*a* is rotated along arrow F and the engaging pawl 81*a* is brought into contact with the engaging surface 82*j* of the first engaging hole portion 82*f* and the engaging surface 82*k* of the second engaging hole portion 82*g*. Thereafter the first push-up member 81 is rotated along arrow G as shown in FIG. 20. As shown in FIG. 21, the torsion coil spring 83 is inserted around the spring engaging portion 82*b* of the second push-up member 82 from the second end of the coil portion 83*a* of the torsion coil spring 83. At this time, as shown in FIG. 22, the support arm portion 83*c* provided on the second end of the coil portion 83*a* is locked by a surface in the paper feed direction (along arrow A2) of the spring stop portion 82*l* of the spring engaging portion 82*b*. The engaging arm portion 83*b* is engaged with the spring engaging portion 81*b* of the first push-up member 81. At this time, a portion engaging with the spring engaging portion 81*b* in the engaging arm portion 83*b* urges the spring engaging portion 81*b* of the first push-up member 81 upward (along arrow C) and toward the first end (along arrow B2) in the direction substantially perpendicular to the paper feed direction (along arrow B). Thus, the push-up member 8 as shown in FIGS. 5 and 7 is assembled.

With reference to FIGS. 3 and 13 to 15, a paper feeding operation of the dye sublimation printer according to the embodiment will be now described.

Figure 13:
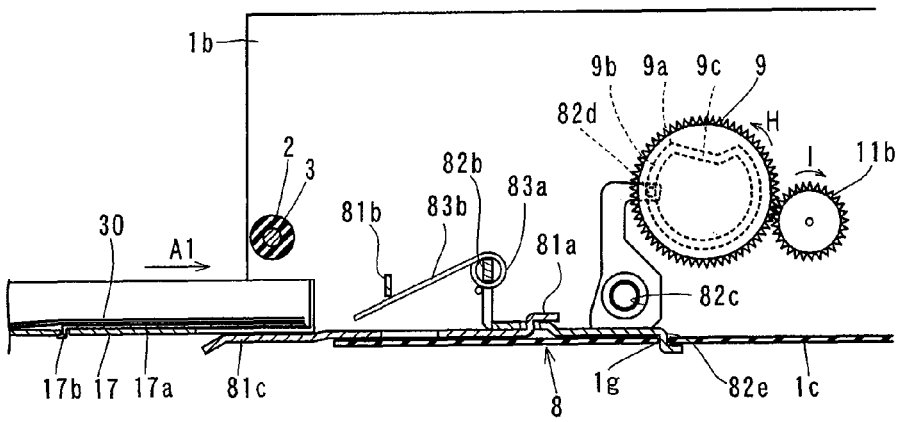
FIGS. 13 to 15 are diagrams for illustrating the structure and an operation of the dye sublimation printer according to the embodiment of the present invention.

As shown in FIG. 13, when the small-diameter gear portion 11*b* of the intermediate gear 11 rotates along arrow H due to the driving force of the motor 10 (see FIG. 3), to rotate the drive gear 9 along arrow I. Thus, the cam engaging portion 82*d* of the second push-up member 82, engaging with the circular groove portion 9*b* of the cam groove 9*a* of the drive gear 9 as shown in FIG. 13, engages with the concave groove portion 9*c* of the cam groove 9*a* of the drive gear 9 as shown in FIG. 14. Thus, the rotating shaft portions 82*e* is mounted on the holes 1*g* and hence the second push-up member 82 rotates by a prescribed angle α along arrow J about the shaft portions 82*f* serving as rotation centers. Therefore, the press portion 81*c* of the first push-up member 81 lifts up the press plate 17*a* of the paper cassette 17, thereby pressing each of the papers 30 supported by the press plate 17*a* against the paper feed roller 2. Then, the driving force of the motor 12 is transmitted to the paper feed roller gear 4 through the motor gear 12*a* and the plurality of intermediate gears 13, as shown in FIG. 3. Thus, the paper feed roller shaft 3 and the paper feed roller 2 rotate along arrow K as shown in FIG. 14, thereby carrying each of the papers 30 in the paper feed direction (along arrow A1). According to the embodiment, the second push-up member 82 also rotates by the prescribed angle α when the press plate 17*a* of the paper feed cassette 17 is loaded with a large number of papers, as shown in FIG. 15. In this case, the first push-up member 81 presses each of the papers 30 against the paper feed roller 2 with a proper (prescribed) pressure through the press plate 17*a* due to deflection of the torsion coil spring 83 downward.

According to the embodiment, as hereinabove described, the push-up member 8 includes the first push-up member 81 having the pressing portion 81*c* supporting each of the papers, the engaging pawl 81*a* and the spring engaging portion 81*b*, and the tabular second push-up member 82 engaged with the first push-up member 81 and integrally having the rotating shaft portions 82*e* rotatably engaged with the pair of the holes 1*g* of the chassis 1, whereby the round shaft shaped rotating shaft requiring machining time in order to rotate the second push-up member 82 with respect to the chassis 1 may not be separately provided. The engaging pawl 81*a* of the first push-up member 81 is rotatably engaged with the engaging hole 82*a* of the second push-up member 82, whereby the first push-up member 81 can be rotated about the engaging hole 82*a* of the second push-up member 82 without using the round shaft shaped rotating shaft. Thus, the round shaft shaped rotating shaft may not be separately provided in order to rotate the first push-up member 81. Consequently, the papers 30 can be pushed up without separately providing the round shaft shaped rotating shaft in order to rotate the push-up member 8 (first and second push-up members 81 and 82). The spring engaging portion 82*b* of the second push-up member 82 is engaged with the coil portion 83*a* of the torsion coil spring 83 and the spring engaging portion 81*b* of the first push-up member 81 is engaged with the engaging arm portion 83*b* of the torsion coil spring 83, whereby the first push-up member 81 pushes up the papers 30 and the torsion coil spring 83 engaged with the spring engaging portion 82*b* of the second push-up member 82 urges the first push-up member 81 when the engaging pawl 81*a* of the first push-up member 81 rotates with respect to the engaging hole 82*a* of the second push-up member 82. Thus, even when the number of the papers 30 varies, the papers 30 can be pressed against the paper feed roller 2 with the proper pressure through deflection of the torsion coil spring 83 in response to the number of the papers 30.

According to the embodiment, the engaging hole 82*a* capable of receiving the engaging pawl 81*a* extending in the paper feed direction (along arrow A1) and having the length smaller than the length in the paper feed direction (along arrow A1) of the engaging pawl 81*a* is provided, whereby the engaging hole 82*a* of the second push-up member 82 and the engaging pawl 81*a* of the first push-up member 81 can be unlikely to disengage with each other.

According to the embodiment, the spring engaging portion 82*b* of the second push-up member 82 includes the spring stop portion 82*l* for inhibiting the engaged coil portion 83*a* of the torsion coil spring 83 from moving toward the first side (along arrow B2) in the direction intersecting with the paper feed direction (along arrow A1) of the papers 30, and the engaging arm portion 83*b* of the torsion coil spring 83 is so engaged with the spring engaging portion 81*b* as to urge the spring engaging portion 81*b* of the first push-up member 81 upward and toward the second side (along arrow B1) intersecting with the paper feed direction (along arrow A1) of the papers 30, whereby the engaging arm portion 83*b* of the torsion coil spring 83 engaging with the second push-up member 82 urges the spring engaging portion 81*b* of the first push-up member 81 upward, so that the first push-up member 81 can be easily rotated upward following upward rotation of the second push-up member 82. Thus, the first push-up member 81 can easily push up the papers 30 and urge against the paper feed roller 2. The engaging arm portion 83*b* of the torsion coil spring 83 urges the spring engaging portion 81*b* of the first push-up member 81 toward the second side (along arrow B1) in the direction intersecting with the paper feed direction (along arrow A1), whereby the engaging pawl 81*a* of the first push-up member 81 can be pressed against the engaging surfaces 82*j* and 82*k* of the engaging hole 82*a*. Thus, disengagement of the engaging pawl 81*a* from the engaging hole 82*a* can be effectively suppressed.

According to the embodiment, the spring engaging portion 81*b* is so formed as to extend upward and be bent toward the first side (along arrow B2) in the direction intersecting with the paper feed direction (along arrow A1) of the papers 30, whereby the portion extending upward in the spring engaging portion 81*b* can receive the urging force of the engaging arm portion 83*b* of the torsion coil spring 83 in the direction (along arrow B) intersecting with the paper feed direction (along arrow A1) of the papers 30, and the portion bending toward the first side (along arrow B2) in the direction intersecting with the paper feed direction (along arrow A1) of the papers 30 in the spring engaging portion 81*b* can receive the urging force of the engaging arm portion 83*b* of the torsion coil spring 83 in paper feed direction (along arrow A1) of the papers 30 and in a vertical direction.

According to the embodiment, the support arm portion 83*c* locked by the spring engaging portion 82*b* is provided on the second end of the coil portion 83*a* of the torsion coil spring 83, whereby the support arm portion 83*c* can inhibit the coil portion 83*a* of the torsion coil spring 83 from rotating around the spring engaging portion 82*b* in an idling manner.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the dye sublimation printer employed as an exemplary image generating apparatus, the present invention is not restricted to this but is also applicable to another image generating apparatus such as an ink jet printer or a laser printer.

While the first push-up member is provided with the engaging pawl and the second push-up member is provided with the engaging hole in the aforementioned embodiment, the present invention is not restricted to this but the first push-up member may be alternatively provided with the engaging hole and the second push-up member may be alternatively provided with the engaging pawl.

While the spring engaging portion 81*b* is bent toward the first side (along arrow B2) in the direction intersecting with the paper feed direction and the spring engaging portion 82*b* is bent toward the second side (along arrow B1) in the direction intersecting with the paper feed direction so that the engaging arm portion 83*b* of the torsion coil spring 83 urges toward the second side (along arrow B1) in the direction intersecting with the paper feed direction in the aforementioned embodiment, the present invention is not restricted to this but the spring engaging portion 81*b* may alternatively be bent toward the second side (along arrow B1) in the direction intersecting with the paper feed direction and the spring engaging portion 82*b* may be alternatively bent toward the first side (along arrow B2) in the direction intersecting with the paper feed direction so that the engaging arm portion 83*b* of the torsion coil spring 83 urges toward the first side (along arrow B2) in the direction intersecting with the paper feed direction.

What is claimed is:

1. An image generating apparatus comprising:

a paper feed roller carrying a paper in a paper feed direction;

a push-up member for pushing up said paper and bringing the same into contact with said paper feed roller; and a chassis on which said paper feed roller and said push-up member are arranged, wherein said push-up member includes:

a first push-up member integrally having a paper support portion supporting said paper, a first engaging portion and a first spring engaging portion, and a tabular second push-up member engaged with said first push-up member and integrally having a rotating shaft portion rotatably engaged with said chassis, a second engaging portion and a second spring engaging portion, and a torsion coil spring engaged with said first push-up member and said second push-up member and having a coil portion and a first arm portion provided on a first end of said coil portion, wherein:

said second engaging portion of said second push-up member is rotatably engaged with said first engaging portion of said first push-up member, said second spring engaging portion of said second push-up member is engaged with said coil portion of said torsion coil spring, said first spring engaging portion of said first push-up member is engaged with said first arm portion of said torsion coil spring, said first engaging portion of said first push-up member includes an engaging pawl extending in said paper feed direction, and said second engaging portion of said second push-up member includes an engaging hole capable of receiving said engaging pawl and having a length smaller than a length in said paper feed direction of said engaging pawl.

2. The image generating apparatus according to claim 1, wherein said engaging hole includes a first engaging hole portion and a second engaging hole portion provided continuous to each other, said first engaging hole portion is provided on a first side in said paper feed direction of said first engaging hole portion and includes a first engaging surface engaged with a first engaging surface of said engaging pawl, said second engaging hole portion is provided on a second side in said paper feed direction of said engaging hole diagonally to said first engaging surface, and includes a second engaging surface engaged with a second engaging surface of said engaging pawl, and lengths in said paper feed direction of said first engaging hole portion and said second engaging hole portion are larger than a thickness of said engaging pawl, and an interval in said paper feed direction between said first engaging surface and said second engaging surface is substantially equal to said thickness of said engaging pawl.

3. The image generating apparatus according to claim 1, wherein said second spring engaging portion of said second push-up member includes a stop portion for inhibiting said engaged coil portion of said torsion coil spring from moving toward a first side in a direction intersecting with said paper feed direction of said paper, and said first arm portion of said torsion coil spring is so engaged with said first spring engaging portion as to urge said first spring engaging portion of said first push-up member upward and toward a second side in said direction intersecting with said paper feed direction of said paper.

4. The image generating apparatus according to claim 3, wherein said first spring engaging portion is so formed as to extend upward and bend toward said first side in said direction intersecting with said paper feed direction of said paper.

5. The image generating apparatus according to claim 1, wherein said torsion coil spring further includes a second arm portion provided on a second end of said coil portion of said torsion coil spring and locked by said second spring engaging portion.

6. The image generating apparatus according to claim 1, further comprising a paper cassette including a press plate, wherein said first push-up member and said second push-up member are formed such that said first engaging portion of said first push-up member is capable of rotating downward with respect to said second engaging portion of said second push-up member when said paper support portion of said first push-up member lifts up said press plate of said paper cassette and said paper comes into contact with said paper feed roller.

7. The image generating apparatus according to claim 6, wherein said torsion coil spring is so formed as to urge said first engaging portion of said first push-up member upward when said paper support portion of said first push-up member lifts up said press plate of said paper cassette and said paper comes into contact with said paper feed roller.

8. An image generating apparatus comprising:

a paper feed roller carrying a paper in a paper feed direction;

a push-up member for pushing up said paper and bringing the same into contact with said paper feed roller; and a chassis on which said paper feed roller and said push-up member are arranged, wherein said push-up member includes:

a first push-up member integrally having a paper support portion supporting said paper, a first engaging portion and a first spring engaging portion, a tabular second push-up member engaged with said first push-up member and integrally having a rotating shaft portion rotatably engaged with said chassis, a second engaging portion and a second spring engaging portion, and a torsion coil spring engaged with said first push-up member and said second push-up member and having a coil portion and a first arm portion provided on a first end of said coil portion, said second engaging portion of said second push-up member is rotatably engaged with said first engaging portion of said first push-up member, said second spring engaging portion of said second push-up member is engaged with said coil portion of said torsion coil spring, said first spring engaging portion of said first push-up member is engaged with said first arm portion of said torsion coil spring, said first engaging portion of said first push-up member includes an engaging pawl extending in said paper feed direction, said second engaging portion of said second push-up member includes an engaging hole capable of receiving said engaging pawl and having a length smaller than the length in said paper feed direction of said engaging pawl, said second spring engaging portion of said second push-up member includes a stop portion for inhibiting said engaged coil portion of said torsion coil spring from moving toward a first side in a direction intersecting with said paper feed direction of said paper, said first arm portion of said torsion coil spring is so engaged with said first spring engaging portion as to urge said first spring engaging portion of said first push-up member upward and toward a second side in said direction intersecting with said paper feed direction of said paper, said first spring engaging portion of said first push-up member is so formed as to extend upward and bend toward said first side in said direction intersecting with said paper feed direction of said paper, and said torsion coil spring further includes a second arm portion provided on a second end of said coil portion of said torsion coil spring and locked by said second spring engaging portion.

9. The image generating apparatus according to claim 8, wherein said engaging hole includes a first engaging hole portion and a second engaging hole portion provided continuous to each other, said first engaging hole portion is provided on a first side in said paper feed direction of said first engaging hole portion and includes a first engaging surface engaged with a first engaging surface of said engaging pawl, said second engaging hole portion is provided on a second side in said paper feed direction of said engaging hole diagonally to said first engaging surface, and includes a second engaging surface engaged with a second engaging surface of said engaging pawl, and lengths in said paper feed direction of said first engaging hole portion and said second engaging hole portion are larger than a thickness of said engaging pawl, and an interval in said paper feed direction between said first engaging surface and said second engaging surface is substantially equal to said thickness of said engaging pawl.

10. The image generating apparatus according to claim 8, further comprising an apparatus body including said paper feed roller, said push-up member and said chassis, wherein said apparatus body is detachably mounted with a paper cassette, said paper cassette includes a press plate arranged above said paper support portion of said first push-up member and arranged with said paper on an upper surface of said press plate, cassette on said apparatus body, and said paper is lifted up by said paper support portion of said first push-up member through said press plate, such that a prescribed range of said paper closer to said first push-up member comes into contact with said paper feed roller.

11. The image generating apparatus according to claim 10, wherein said first push-up member and said second push-up member are formed such that said first engaging portion of said first push-up member is capable of rotating downward with respect to said second engaging portion of said second push-up member when said paper support portion of said first push-up member lifts up said press plate of said paper cassette and said paper comes into contact with said paper feed roller.

12. The image generating apparatus according to claim 11, wherein said torsion coil spring is so formed as to urge said first engaging portion of said first push-up member upward when said paper support portion of said first push-up member lifts up said press plate of said paper cassette and said paper comes into contact with said paper feed roller.

* * * * *